US007635393B2

(12) United States Patent
Hsu et al.

(10) Patent No.: US 7,635,393 B2
(45) Date of Patent: Dec. 22, 2009

(54) LIQUID LAUNDRY DETERGENT WITH AN ALKOXYLATED ESTER SURFACTANT AND UREA

(75) Inventors: Feng-Lung Gordon Hsu, Tenafly, NJ (US); Mei Shi, Ridgewood, NY (US)

(73) Assignee: The Sun Products Corporation, Wilton, CT (US)

( * ) Notice: Subject to any disclaimer, the term of this patent is extended or adjusted under 35 U.S.C. 154(b) by 0 days.

(21) Appl. No.: 11/810,555

(22) Filed: Jun. 6, 2007

(65) Prior Publication Data

US 2007/0287654 A1 Dec. 13, 2007

Related U.S. Application Data

(60) Provisional application No. 60/804,179, filed on Jun. 8, 2006.

(51) Int. Cl.

| | |
|---|---|
| ***B08B 3/04*** | (2006.01) |
| ***C11D 1/04*** | (2006.01) |
| ***C11D 1/74*** | (2006.01) |
| ***C11D 9/30*** | (2006.01) |

(52) U.S. Cl. ..... 8/137; 510/356; 510/360; 510/421; 510/475; 510/501; 8/137.5

(58) Field of Classification Search ..... 510/356, 510/360, 421, 475, 501; 8/137, 137.5
See application file for complete search history.

(56) References Cited

U.S. PATENT DOCUMENTS

| | | | | |
|---|---|---|---|---|
| 5,753,606 | A | 5/1998 | Hees et al. | 510/422 |
| 6,046,146 | A | 4/2000 | Erilli | 510/130 |
| 6,071,873 | A | 6/2000 | Mertens | 510/417 |
| 6,156,717 | A * | 12/2000 | Erilli et al. | 510/426 |
| 6,319,887 | B1 | 11/2001 | Mertens | 510/417 |
| 6,384,009 | B1 | 5/2002 | Koester et al. | 510/421 |
| 6,417,146 | B1 | 7/2002 | Miyajima et al. | 510/130 |
| 6,602,838 | B1 * | 8/2003 | Koester et al. | 510/235 |

FOREIGN PATENT DOCUMENTS

| | | |
|---|---|---|
| JP | 8-157897 | 6/1996 |
| JP | 8-209193 | 8/1996 |
| JP | 9-78092 | 3/1997 |
| JP | 9-104895 | 4/1997 |
| JP | 34 10880 | 3/2003 |
| WO | 94/13618 | 6/1994 |
| WO | 95/14765 | 6/1995 |
| WO | 96/23049 | 8/1996 |
| WO | 01/10391 | 2/2001 |
| WO | 2007/039026 | 4/2007 |

OTHER PUBLICATIONS

Derwent Abstract of WO 96/23049, published Aug. 1, 1996.
Derwent Abstract of WO 94/13618, published Jun. 23, 1994.
Derwent Abstract of JP 9-78092, published Mar. 25, 1997.
Derwent Abstract of JP 9-104895, published Apr. 22, 1997.
Derwent Abstract of JP 8-157897, published Jun. 18, 1996.
Derwent Abstract of JP 8-209193, published Aug. 13, 1996.
Derwent Abstract of JP 34 10880, published Mar. 20, 2003.
PCT International Search Report in a PCT application PCT/EP2007/054699, Aug. 6, 2007.

* cited by examiner

*Primary Examiner*—Brian P Mruk
(74) *Attorney, Agent, or Firm*—Sterne, Kessler, Goldstein & Fox PLLC

(57) ABSTRACT

An aqueous liquid laundry detergent composition comprising an alkoxylated carboxylic acid surfactant and urea at pH 6-8. The composition has improved performance on grass stain removal.

4 Claims, No Drawings

LIQUID LAUNDRY DETERGENT WITH AN ALKOXYLATED ESTER SURFACTANT AND UREA

This application claims the benefit of U.S. provisional application No. 60/804,179 filed Jun. 8, 2006.

FIELD OF THE INVENTION

The present invention relates to liquid aqueous laundry detergent compositions comprising alkoxylated carboxylic acid ester surfactants and urea.

BACKGROUND OF THE INVENTION

Liquid laundry detergents are popular with the consumers. While a variety of surfactants is available to manufacturers to formulate these, it is desirable to include alkoxylated ester surfactants, due to their better bio-degradability in comparison to alcohol-based alkoxylates. In addition, alkoxylated ester surfactants are derived from a renewable source—oil and fat. Unfortunately, alkoxylated ester surfactants hydrolyse in the presence of water, and especially under alkaline conditions. The hydrolysis has a dual disadvantage of destroying the surfactant and introducing fatty acid, one of the degradation products, which is, essentially, oily soil. The hydrolysis of acid esters occurs in an aqueous, high pH environment, and so may occur in the bottled compositions on storage. Thus, compositions containing alkoxylated ester surfactant need to be formulated at pH 6 to 8. Unfortunately, the cleaning performance of the laundry compositions is impaired at such lower pH, especially the removal of grass stains—an extremely important stain, especially on kids clothes or sportswear.

The following art describes compositions, in some instances laundry compositions, that may include various, broadly ranging carboxylic acid esters and/or alkoxylated derivatives thereof, some of which may also contain urea: Mertens (U.S. Pat. Nos. 6,071,873 and 6,319,887), Koester et al. (U.S. Pat. No. 6,384,009), Hees et al. (U.S. Pat. No. 5,753,606), WO 01/10391, WO 96/23049, WO 94/13618, Miyajima et al. (U.S. Pat. No. 6,417,146), JP 9078092, JP 9104895, JP 8157897, JP 8209193 and JP 3410880.

SUMMARY OF THE INVENTION

The present invention is based at least in part on the discovery that the addition of relatively small amounts of urea result in the synergistic improvement of grass stain removal in compositions containing alkoxylated ester surfactant, at pH 6 to 8.

The present invention includes an aqueous liquid laundry detergent composition comprising:

(a) from about 5% to about 80%, by weight of the composition, of a detergent surfactant, wherein from about 1% to about 80%, by weight of the composition is an alkoxylated carboxylic acid ester surfactant of formula (I):

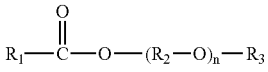

wherein $R_1$ is selected from linear or branched $C_6$ to $C_{22}$ alkyl or alkylene groups;

$R_2$ is selected from $C_2H_4$ or $C_3H_6$ groups;

$R_3$ is selected from H, $CH_3$, $C_2H_5$ or $C_3H_7$ groups;

and n has a value between 1 and 20, (b) from about 0.01 to about 5% of urea;

(c) wherein the pH of the composition is in the range from about 6 to about 8;

(d) from about 15% to about 90% of water.

The invention also includes an aqueous wash liquor resulting from the use of the composition in laundering fabrics, the wash liquor comprising the alkoxylated ester surfactant and urea.

DETAILED DESCRIPTION OF THE INVENTION

Except in the operating and comparative examples, or where otherwise explicitly indicated, all numbers in this description indicating amounts of material or conditions of reaction, physical properties of materials and/or use are to be understood as modified by the word "about." All amounts are by weight of the liquid detergent composition, unless otherwise specified.

It should be noted that in specifying any range of concentration, any particular upper concentration can be associated with any particular lower concentration.

For the avoidance of doubt the word "comprising" is used herein in its ordinary meaning and is intended to mean "including" but not necessarily "consisting of" or "composed of." In other words, the listed steps or options need not be exhaustive.

"Liquid" as used herein means that a continuous phase or predominant part of the composition is liquid and that a composition is flowable at 15° C. and above (i.e., suspended solids may be included). Gels are included in the definition of liquid compositions as used herein.

ALKOXYLATED CARBOXYLIC ACID ESTERS (also sometimes referred to herein as "alkoxylated esters") included in the present invention have Formula (I) as follows:

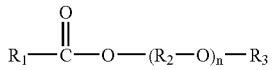

Where $R_1$ is selected from linear or branched $C_6$ to $C_{22}$ alkyl or alkylene groups;

$R_2$ are selected from $C_2H_4$ or $C_3H_6$ groups;

$R_3$ are selected from H, $CH_3$ $C_2H_5$ or $C_3H_7$ groups;

and n has a value between 1 and 20.

Preferably, R1 is selected from $C_{12}$ to $C_{18}$,

R2 is $C_2H_4$,

R3 is selected from $CH_3$ and $C_2H_5$, and n is a value between 3 and 15, most preferably from 5 to 12.

The preferred compounds of formula (I) in the inventive compositions are selected from alkoxylated derivatives derived from coconut, palm, palm kernel, palm stearin, tallow, soybean and rapeseed oil due to their availability.

Carboxylic acid esters are available commercially or may be prepared by the alcoholysis of glycerides, preferably from natural oil or fat, and the esterification of carboxylic acid with alcohol, e.g. methanol or ethanol, to form carboxylic acid ester; the alkoxylated derivatives may be obtained by the alkoxylation of carboxylic acid ester with alkylene oxide with the presence of catalyst. Carboxylic acid esters are also widely available as "bio-diesel". Twin River Technologies provides various types of carboxylic acid esters. Huntsman provides various alkoxylated carboxylic methyl esters.

The amount of the alkoxylated derivative of ester employed in the inventive compositions is in the range of from 1% to 80%, preferably from 2% to 50%, most preferably from 3% to 20%, optimally from 4% to 15%, by weight of the composition. The concentration of alkoxylated esters in an aqueous wash liquor preferably in the range of from 1 ppm to 1000 ppm.

Surfactant

The overall amount of surfactant in the inventive compositions is generally in the range of from 5 to 80%, preferably from 10 to 60%, most preferably from 15 to 30%. The alkoxylated ester of the present invention is a nonionic surfactant. Thus, the alkoxylated ester may be the sole surfactant in the composition, or may be co-present with other surfactants. Preferably the alkoxylated ester surfactant is included in the inventive compositions in combination with anionic, cationic and amphoteric surfactant, most preferably anionic surfactant. The preferred ratio of alkoxylated ester surfactant to the sum of other surfactants is between 5:1 to 1:5, and more preferably between 3:1 to 1:3.

Furthermore, it is to be understood that any surfactant described below may be used in combination with any other surfactant or surfactants.

Anionic Surfactant Detergents

Anionic surface active agents which may be used in the present invention are those surface active compounds which contain a long chain hydrocarbon hydrophobic group in their molecular structure and a hydrophilic group, i.e. water soluble group such as carboxylate, sulfonate or sulfate group or their corresponding acid form. The anionic surface active agents include the alkali metal (e.g. sodium and potassium) and nitrogen based bases (e.g. mono-amines and polyamines) salts of water soluble higher alkyl aryl suffocates, alkyl sulfonates, alkyl sulfates and the alkyl polyether sulfates. They may also include fatty acid or fatty acid soaps. One of the preferred groups of mono-anionic surface active agents are the alkali metal, ammonium or alkanolamine salts of higher alkyl aryl sulfonates and alkali metal, ammonium or alkanolamine salts of higher alkyl sulfates or the mono-anionic polyamine salts. Preferred higher alkyl sulfates are those in which the alkyl groups contain 8 to 26 carbon atoms, preferably 12 to 22 carbon atoms and more preferably 14 to 18 carbon atoms. The alkyl group in the alkyl aryl sulfonate preferably contains 8 to 16 carbon atoms and more preferably 10 to 15 carbon atoms. A particularly preferred alkyl aryl sulfonate is the sodium, potassium or ethanolamine $C_{10}$ to $C_{16}$ benzene sulfonate, e.g. sodium linear dodecyl benzene sulfonate. The primary and secondary alkyl sulfates can be made by reacting long chain olefins with sulfites or bisulfites, e.g. sodium bisulfite. The alkyl sulfonates can also be made by reacting long chain normal paraffin hydrocarbons with sulfur dioxide and oxygen as describe in U.S. Pat. Nos. 2,503,280, 2,507,088, 3,372,188 and 3,260,741 to obtain normal or secondary higher alkyl sulfates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined, for example, to the 2-carbon atom of the chain, i.e. may be a secondary sulfonate. It is understood in the art that the substituent may be joined to any carbon on the alkyl chain.

The higher alkyl sulfonates can be used as the alkali metal salts, such as sodium and potassium. The preferred salts are the sodium salts. The preferred alkyl sulfonates are the $C_{10}$ to $C_{18}$ primary normal alkyl sodium and potassium sulfonates, with the $C_{10}$ to $C_{15}$ primary normal alkyl sulfonate salt being more preferred.

Mixtures of higher alkyl benzene sulfonates and higher alkyl sulfates can be used as well as mixtures of higher alkyl benzene sulfonates and higher alkyl polyether sulfates.

The higher alkyl polyethoxy sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl polyethoxy sulfates used in accordance with the present invention are represented by the formula:

$$R^1—O(CH_2CH_2O)_p—SO_3M,$$

where $R^1$ is $C_8$ to $C_{20}$ alkyl, preferably $C_{10}$ to $C_{18}$ and more preferably $C_{12}$ to $C_{15}$; p is 1 to 8, preferably 2 to 6, and more preferably 2 to 4; and M is an alkali metal, such as sodium and potassium, an ammonium cation or polyamine. The sodium and potassium salts, and polyaimines are preferred.

A preferred higher alkyl poly ethoxylated sulfate is the sodium salt of a triethoxy $C_{12}$ to $C_{15}$ alcohol sulfate having the formula:

$$C_{12\text{-}15}—O—(CH_2CH_2O)_3—SO_3Na$$

Examples of suitable alkyl ethoxy sulfates that can be used in accordance with the present invention are $C_{12\text{-}15}$ normal or primary alkyl triethoxy sulfate, sodium salt; n-decyl diethoxy sulfate, sodium salt; $C_{12}$ primary alkyl diethoxy sulfate, ammonium salt; $C_{12}$ primary alkyl triethoxy sulfate, sodium salt; $C_{15}$ primary alkyl tetraethoxy sulfate, sodium salt; mixed $C_{14\text{-}15}$ normal primary alkyl mixed tri- and tetraethoxy sulfate, sodium salt; stearyl pentaethoxy sulfate, sodium salt; and mixed $C_{10\text{-}18}$ normal primary alkyl triethoxy sulfate, potassium salt.

The normal alkyl ethoxy sulfates are readily biodegradable and are preferred. The alkyl poly-lower alkoxy sulfates can be used in mixtures with each other and/or in mixtures with the above discussed higher alkyl benzene, sulfonates, or alkyl sulfates.

The anionic surfactant is present in an amount of from 0 to 70%, preferably at least 5%, generally from 5 to 50%, more preferably from 5 to 20%.

Additional Nonionic Surfactant

Nonionic surfactants in addition to the alkoxylated ester surfactants may be included. As is well known, the nonionic surfactants are characterized by the presence of a hydrophobic group and an organic hydrophilic group and are typically produced by the condensation of an organic aliphatic or alkyl aromatic hydrophobic compound with ethylene oxide (hydrophilic in nature). Typical suitable nonionic surfactants are those disclosed in U.S. Pat. Nos. 4,316,812 and 3,630,929, incorporated by reference herein.

Usually, the nonionic surfactants are polyalkoxylated lipophiles wherein the desired hydrophile-lipophile balance is obtained from addition of a hydrophilic poly-alkoxy group to a lipophilic moiety. A preferred class of nonionic detergent is the alkoxylated alkanols wherein the alkanol is of 9 to 20 carbon atoms and wherein the number of moles of alkylene oxide (of 2 or 3 carbon atoms) is from 3 to 20. Of such materials it is preferred to employ those wherein the alkanol is a fatty alcohol of 9 to 11 or 12 to 15 carbon atoms and which contain from 5 to 9 or 5 to 12 alkoxy groups per mole. Also preferred is paraffin—based alcohol (e.g. nonionics from Huntsman or Sassol).

Exemplary of such compounds are those wherein the alkanol is of 10 to 15 carbon atoms and which contain about 5 to 12 ethylene oxide groups per mole, e.g. Neodol® 25-9 and Neodol® 23-6.5, which products are made by Shell Chemical Company, Inc. The former is a condensation product of a mixture of higher fatty alcohols averaging about 12 to 15 carbon atoms, with about 9 moles of ethylene oxide and the latter is a corresponding mixture wherein the carbon atoms content of the higher fatty alcohol is 12 to 13 and the number of ethylene oxide groups present averages about 6.5. The higher alcohols are primary alkanols.

Another subclass of alkoxylated surfactants which can be used contain a precise alkyl chain length rather than an alkyl chain distribution of the alkoxylated surfactants described above. Typically, these are referred to as narrow range alkoxylates. Examples of these include the Neodol-1® series of surfactants manufactured by Shell Chemical Company.

Other useful nonionics are represented by the commercially well known class of nonionics sold under the trademark Plurafac® by BASF. The Plurafacs® are the reaction products of a higher linear alcohol and a mixture of ethylene and propylene oxides, containing a mixed chain of ethylene oxide and propylene oxide, terminated by a hydroxyl group. Examples include $C_{13}$-$C_{15}$ fatty alcohol condensed with 6 moles ethylene oxide and 3 moles propylene oxide, $C_{13}$-$C_{15}$ fatty alcohol condensed with 7 moles propylene oxide and 4 moles ethylene oxide, $C_{13}$-$C_{15}$ fatty alcohol condensed with 5 moles propylene oxide and 10 moles ethylene oxide or mixtures of any of the above.

Another group of liquid nonionics are commercially available from Shell Chemical Company, Inc. under the Dobanol® or Neodol® trademark: Dobanol® 91-5 is an ethoxylated $C_9$-$C_{11}$ fatty alcohol with an average of 5 moles ethylene oxide and Dobanol® 25-7 is an ethoxylated $C_{12}$-$C_{15}$ fatty alcohol with an average of 7 moles ethylene oxide per mole of fatty alcohol.

In the compositions of this invention, preferred nonionic surfactants include the $C_{12}$-$C_{15}$ primary fatty alcohols with relatively narrow contents of ethylene oxide in the range of from about 6 to 9 moles, and the $C_9$ to $C_{11}$ fatty alcohols ethoxylated with about 5-6 moles ethylene oxide.

Another class of nonionic surfactants which can be used in accordance with this invention are glycoside surfactants. Glycoside surfactants suitable for use in accordance with the present invention include those of the formula:

$$RO—(R^2O)_y—(Z)_x$$

wherein R is a monovalent organic radical containing from about 6 to about 30 (preferably from about 8 to about 18) carbon atoms; $R^2$ is a divalent hydrocarbon radical containing from about 2 to 4 carbons atoms; O is an oxygen atom; y is a number which can have an average value of from 0 to about 12 but which is most preferably zero; Z is a moiety derived from a reducing saccharide containing 5 or 6 carbon atoms; and x is a number having an average value of from 1 to about 10 (preferably from about 1½ to about 10).

A particularly preferred group of glycoside surfactants for use in the practice of this invention includes those of the formula above in which R is a monovalent organic radical (linear or branched) containing from about 6 to about 18 (especially from about 8 to about 18) carbon atoms; y is zero; z is glucose or a moiety derived therefrom; x is a number having an average value of from 1 to about 4 (preferably from about 1½ to 4). Nonionic surfactants which may be used include polyhydroxy amides as discussed in U.S. Pat. No. 5,312,954 to Letton et al. and aldobionamides such as disclosed in U.S. Pat. No. 5,389,279 to Au et al., both of which are hereby incorporated by reference into the subject application.

Mixtures of two or more of the nonionic surfactants can be used.

Generally, nonionics (other than alkoxylated esters required by the present invention) would comprise 0-75%, preferably 2 to 50%, more preferably 0 to 15%, most preferably 0 to 10%. The level of nonionic surfactant may be lowered compared to the typical compositions, due to the unexpected advantage of the esters/alkoxylated derivatives in the inventive compositions contribution to the oily soil removal.

Preferred inventive compositions comprise both anionic and nonionic surfactants, typically in a weight ratio of from 1:4 to 4:1.

Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Specific cationic surfactants which can be used as surfactants in the subject invention are described in detail in U.S. Pat. No. 4,497,718, hereby incorporated by reference.

As with the nonionic and anionic surfactants, the compositions of the invention may use cationic surfactants alone or in combination with any of the other surfactants known in the art. Of course, the compositions may contain no cationic surfactants at all.

Amphoteric Surfactants

Ampholytic synthetic surfactants can be broadly described as derivatives of aliphatic or aliphatic derivatives of heterocyclic secondary and tertiary amines in which the aliphatic radical may be straight chain or branched and wherein one of the aliphatic substituents contains from about 8 to 18 carbon atoms and at least one contains an anionic water-soluble group, e.g. carboxylate, sulfonate, sulfate. Examples of compounds falling within this definition are sodium 3-(dodecylamino)propionate, sodium 3-(dodecylamino) propane-1-sulfonate, sodium 2-(dodecylamino)ethyl sulfate, sodium 2-(dimethylamino) octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. Sodium 3-(dodecylamino) propane-1-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water-soluble group, e.g., carboxy, sulfonate, sulfate, phosphate, or phosphonate.

Specific examples of zwitterionic surfactants which may be used are set forth in U.S. Pat. No. 4,062,647, hereby incorporated by reference.

Urea

By virtue of inclusion of urea into the inventive compositions, the performance of alkoxylated ester containing compositions is improved at pH 6 to 8, especially the removal of grassy stains. The amount of urea is important. Generally, urea is present in the inventive compositions in an amount of from 0.01% to 5%, preferably, in order to achieve the synergy with MEE in grass stain removal, from 0.1% to 3%, most preferably from 0.5% to 2%. Too high an amount of urea results in too low formulation viscosity and high formulation cost, amounts below 0.005% result in the diminishing of synergy with MEE in grass stain removal.

Water

The inventive compositions are aqueous. The inventive compositions comprise generally from 15% to 90%, preferably from 30% to 80%, most preferably, to achieve optimum cost and ease of manufacturing, from 50% to 70% of water. Other liquid components, such as solvents, surfactants, liquid organic matters including organic bases, and their mixtures can be co-present.

Solvents that may be present include but are not limited to alcohols, surfactant, fatty alcohol ethoxylated sulfate or surfactant mixes, alkanol amine, polyamine, other polar or non-polar solvents, and mixtures thereof.

pH

The pH of the inventive compositions is generally in the range of from 6 to 8, preferably 6.5 to 8 and most preferably from 6.7 to 7.5. Surprisingly, even at this less than alkaline pH the performance of alkoxylated ester nonionic surfactant is improved, by virtue of the inclusion of urea. If pH is higher than 8, the degradation of the alkoxylated ester surfactant may be significant, and also a portion of urea is converted to ammonia, resulting in an unpleasant smell and deterioration of performance. If pH is lower than 6, a portion of anionic surfactant is not neutralized leading to loss of efficacy. Also, performance of other optional ingredients, e.g. enzyme, is poor at an acidic pH.

Additional Laundry Ingredients

Builders/Electrolytes

The most preferred optional ingredient is an alkaline builder, in order to provide alkaline washing condition and sequester hardness.

Builders which can be used according to this invention include conventional alkaline detergency builders, inorganic or organic, which should be used at levels from about 0.1% to about 20.0% by weight of the composition, preferably from 1.0% to about 10.0% by weight, more preferably 2% to 5% by weight.

As electrolyte may be used any water-soluble salt. Electrolyte may also be a detergency builder, such as the inorganic builder sodium tripolyphosphate, or it may be a non-functional electrolyte such as sodium sulphate or chloride. Preferably the inorganic builder comprises all or part of the electrolyte. That is the term electrolyte encompasses both builders and salts.

Examples of suitable inorganic alkaline detergency builders which may be used are water-soluble alkalimetal phosphates, polyphosphates, borates, silicates and also carbonates. Specific examples of such salts are sodium and potassium triphosphates, pyrophosphates, orthophosphates, hexametaphosphates, tetraborates, silicates and carbonates.

Examples of suitable organic alkaline detergency builder salts are: (1) water-soluble amino polycarboxylates, e.g., odium and potassium ethylenediaminetetraacetates, nitrilotriacetatesand N-(2 hydroxyethyl)-nitrilodiacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid hydroxymethanediphosphonic acid, carboxyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; (4) water-soluble salts of polycarboxylate polymers and copolymers as described in U.S. Pat. No 3,308,067.

In addition, polycarboxylate builders can be used satisfactorily, including water-soluble salts of mellitic acid, citric acid, and carboxymethyloxysuccinic acid, imino disuccinate, salts of polymers of itaconic acid and maleic acid, tartrate monosuccinate, tartrate disuccinate and mixtures thereof.

Sodium citrate is particularly preferred, to optimize the function vs. cost, in an amount of from 0 to 15%, preferably from 1 to 10%.

Certain zeolites or aluminosilicates can be used. One such aluminosilicate which is useful in the compositions of the invention is an amorphous water-insoluble hydrated compound of the formula $(NaAlO_2)_x—(SiO_2)_y$, wherein x is a number from 1.0 to 1.2 and y is 1, said amorphous material being further characterized by a Mg++ exchange capacity of from about 50 mg eq. $CaCO_3$/g. and a particle diameter of from about 0.01 micron to about 5 microns. This ion exchange builder is more fully described in British Pat. No. 1,470,250.

A second water-insoluble synthetic aluminosilicate ion exchange material useful herein is crystalline in nature and has the formula $Na_z[(AlO_2)_y.(SiO_2)]xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium exchange rate on an anhydrous basis of at least about 2 grains/gallon/minute/gram. These synthetic aluminosilicates are more fully described in British Patent No. 1,429,143.

Free Radical Scavenger

The inventive compositions preferably include a free radical scavenger, inorder to further minimise the alkoxylated ester degradation under alkaline pH conditions. Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anisole (BHA), benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene.

The amounts of free radical scavenger in the inventive compositions are important. If too low an amount is employed, relative to the amount of the alkoxylated ester, then of course the hydrolysis of the ester still occurs. If too high an amount is included, relative to the amount of the alkoxylated ester, then the free radical scavenger is oxidised; the presence of substantial amounts of greater than 0.2% of free radical scavenger in a composition results in yellowing of the composition, due to increased amounts of oxidised free radical scavenger. According to the present invention, the mole ratio of the alkoxylated ester to the free radical scavenger is in the range from 500:1 to 20:1, preferably from 250:1 to 30:1, most preferably from 200:1 to 50:1.

Generally, the amount of free radical scavenger in the inventive composition is at most 0.2%, preferably at most 0.1%, most preferably at most 0.05%, in order to optimise preservation of the alkoxylated ester surfactant, while avoiding the yellowing of the composition. During the wash, the aqueous laundry wash liquor preferably contains from about from about 0.01 ppm to about 12 ppm of free radical scavenger in order to ensure the protection of ester surfactants.

The inventive compositions may include additional carboxylic acid esters and/or alkoxylated derivatives thereof, in addition to alkoxylated esters already included in the present invention.

The inventive compositions include an additional laundry ingredient selected from the group consisting of enzyme, fluorescent agent, soil release polymer, anti-redeposition polymer and mixtures thereof. These are described in greater detail below. Additional laundry ingredients described below are optional.

Enzymes

One or more enzymes as described in detail below, may be used in the compositions of the invention.

If a lipase is used, it has to be isolated from the alkoxylated ester surfactant in the inventive compositions, either by encapsulation or in separate compartments due to the ability of lipase to decompose esters. The lipolytic enzyme may be either a fungal lipase producible by Humicola_lanuginosa and Thermomyces lanuginosus, or a bacterial lipase which show a positive immunological cross-reaction with the antibody of the lipase produced by the microorganism Chromobacter viscosum var. lipolyticum NRRL B-3673.

An example of a fungal lipase as defined above is the lipase ex Humicola lanuginosa, available from Amano under the tradename Amano CE; the lipase ex Humicola lanuginosa as described in the aforesaid European Patent Application 0,258,068 (NOVO), as well as the lipase obtained by cloning the gene from Humicola lanuginosa and expressing this gene in Aspergillus oryzae, commercially available from Novozymes under the tradename "Lipolase". This lipolase is a preferred lipase for use in the present invention.

While various specific lipase enzymes have been described above, it is to be understood that any lipase which can confer the desired lipolytic activity to the composition may be used and the invention is not intended to be limited in any way by specific choice of lipase enzyme.

The lipases of this embodiment of the invention are included in the liquid detergent composition in such an amount that the final composition has a lipolytic enzyme activity of from 100 to 0.005 LU/ml in the wash cycle, preferably 25 to 0.05 LU/ml when the formulation is dosed at a level of about 0.1-10, more preferably 0.5-7, most preferably 1-2 g/liter.

Naturally, mixtures of the above lipases can be used. The lipases can be used in their non-purified form or in a purified form, e.g. purified with the aid of well-known absorption methods, such as phenyl sepharose absorption techniques.

If a protease is used, the proteolytic enzyme can be of vegetable, animal or microorganism origin. Preferably, it is of the latter origin, which includes yeasts, fungi, molds and bacteria. Particularly preferred are bacterial subtilisin type proteases, obtained from e.g. particular strains of *B. subtilis* and *B licheniformis*. Examples of suitable commercially available proteases are Alcalase®, Savinase®, Esperase®, all of Novozymes; Maxatase® and Maxacal® of Gist-Brocades; Kazusase® of Showa Denko. The amount of proteolytic enzyme, included in the composition, ranges from 0.05-50,000 GU/mg. preferably 0.1 to 50 GU/mg, based on the final composition. Naturally, mixtures of different proteolytic enzymes may be used.

While various specific enzymes have been described above, it is to be understood that any protease which can confer the desired proteolytic activity to the composition may be used and this embodiment of the invention is not limited in any way to a specific choice of proteolytic enzyme.

In addition to lipases or proteases, it is to be understood that other enzymes such as cellulases, oxidases, amylases, peroxidases and the like which are well known in the art may also be used with the composition of the invention. The enzymes may be used together with co-factors required to promote enzyme activity, i.e., they may be used in enzyme systems, if required. It should also be understood that enzymes having mutations at various positions (e.g., enzymes engineered for performance and/or stability enhancement) are also contemplated by the invention.

The enzyme stabilization system may comprise calcium ion; boric acid, propylene glycol and/or short chain carboxylic acids. The composition preferably contains from about 0.01 to about 50, preferably from about 0.1 to about 30, more preferably from about 1 to about 20 millimoles of calcium ion per liter.

When calcium ion is used, the level of calcium ion should be selected so that there is always some minimum level available for the enzyme after allowing for complexation with builders, etc., in the composition. Any water-soluble calcium salt can be used as the source of calcium ion, including calcium chloride, calcium formate, calcium acetate and calcium propionate. A small amount of calcium ion, generally from about 0.05 to about 2.5 millimoles per liter, is often also present in the composition due to calcium in the enzyme slurry and formula water.

Another enzyme stabilizer which may be used is propionic acid or a propionic acid salt capable of forming propionic acid. When used, this stabilizer may be used in an amount from about 0.1% to about 15% by weight of the composition.

Another preferred enzyme stabilizer is polyols containing only carbon, hydrogen and oxygen atoms. They preferably contain from 2 to 6 carbon atoms and from 2 to 6 hydroxy groups. Examples include propylene glycol (especially 1,2 propane diol which is preferred), ethylene glycol, glycerol, sorbitol, mannitol and glucose. The polyol generally represents from about 0.1 to 25% by weight, preferably about 1.0% to about 15%, more preferably from about 2% to about 8% by weight of the composition.

The composition herein may also optionally contain from about 0.25% to about 5%, most preferably from about 0.5% to about 3% by weight of boric acid. The boric acid may be, but is preferably not, formed by a compound capable of forming boric acid in the composition. Boric acid is preferred, although other compounds such as boric oxide, borax and other alkali metal borates (e.g., sodium ortho-, meta- and pyroborate and sodium pentaborate) are suitable. Substituted boric acids (e.g., phenylboronic acid, butane boronic acid and a p-bromo phenylboronic acid) can also be used in place of boric acid.

One preferred stabilization system is a polyol in combination with boric acid. Preferably, the weight ratio of polyol to boric acid added is at least 1, more preferably at least about 1.3.

Another preferred stabilization system is the pH jump system such as is taught in U.S. Pat. No. 5,089,163 to Aronson et al., hereby incorporated by reference into the subject application. A pH jump heavy duty liquid is a composition containing a system of components designed to adjust the pH of the wash liquor. To achieve the required pH regimes, a pH jump system can be employed in this invention to keep the pH of the product low for enzyme stability in multiple enzyme systems (e.g., protease and lipase systems) yet allow it to become moderately high in the wash for detergency efficacy. One such system is borax $10H_2O$/polyol. Borate ion and certain cis 1,2 polyols complex when concentrated to cause a reduction in pH. Upon dilution, the complex dissociates, liberating free borate to raise the pH. Examples of polyols which exhibit this complexing mechanism with borax include catechol, galacitol, fructose, sorbitol and pinacol. For economic reasons, sorbitol is the preferred polyol.

Sorbitol or equivalent component (i.e., 1,2 polyols noted above) is used in the pH jump formulation in an amount from about 1 to 25% by wt., preferably 3 to 15% by wt. of the composition.

Borate or boron compound is used in the pH jump composition in an amount from about 0.5 to 10.0% by weight of the composition, preferably 1 to 5% by weight.

Alkalinity buffers which may be added to the compositions of the invention include monoethanolamine, triethanolamine, borax and the like.

The inventive compositions preferably include from 0.01% to 2.0%, more preferably from 0.05% to 1.0%, most preferably from 0.05% to 0.5% of a fluorescer. Examples of suitable fluorescers include but are not limited to derivative of stilbene, pyrazoline, coumarin, carboxylic acid, methinecyamines, dibenzothiophene-5,5-dioxide azoles, 5-, and 6-membered-ring heterocycles, triazole and benzidine sulfone compositions, especially sulfonated substituted triazinyl stilbene, sulfonated naphthotriazole stilbene, benzidene sulfone, etc. Most preferred are UV/stable brighteners (for compositions visible in transparent containers), such as distyrylbiphenyl derivatives (Tinopal® CBS-X).

In addition, various other detergent additives or adjuvants may be present in the detergent product to give it additional desired properties, either of functional or aesthetic nature.

Improvements in the physical stability and anti-settling properties of the composition may be achieved by the addition of a small effective amount of an aluminum salt of a higher fatty acid, e.g., aluminum stearate, to the composition. The aluminum stearate stabilizing agent can be added in an amount of 0 to 3%, preferably 0.1 to 2.0% and more preferably 0.5 to 1.5%.

There also may be included in the formulation, minor amounts of soil suspending or anti-redeposition agents, e.g. polyvinyl alcohol, fatty amides, sodium carboxymethyl cellulose, hydroxy-propyl methyl cellulose. A preferred anti-redeposition agent is sodium carboxylmethyl cellulose having a 2:1 ratio of CM/MC which is sold under the tradename Relatin DM 4050.

Anti-foam agents, e.g. silicon compounds, such as Silicane® L 7604, can also be added.

Bactericides, e.g. tetrachlorosalicylanilide and hexachlorophene, fungicides, dyes, pigments (water dispersible), preservatives, e.g. formalin, ultraviolet absorbers, anti-yellowing agents, such as sodium carboxymethyl cellulose, pH modifiers and pH buffers, color safe bleaches, perfume and dyes and bluing agents such as Iragon Blue L2D, Detergent Blue 472/572 and ultramarine blue can be used.

Also, soil release polymers and cationic softening agents may be used.

Preferably, the detergent composition is a colored composition packaged in the transparent/translucent ("see-through") container.

Process of Making

The inventive compositions may be prepared by any method known to one of ordinary skill in the art. Typically, water, a strong base, e.g. NaOH, borax, citric acid are added to the main mixer, followed by surfactants, including the alkoxylated ester surfactant. Borax and/or citrate can be used for controlling pH. The rest of the ingredients, if any, such as, whitening agent, functional polymers, perfume, enzyme, colorant, preservatives are then mixed to obtain an isotropic liquid. In general, the alkoxylated ester surfactant is preferably not contacted with a strong base, e.g. NaOH, to prevent the degradation of the surfactant. If the contact between the alkoxylated ester surfactant and a strong base is necessary, then the contact time should be kept as short as possible. Urea is generally added after the end of all neutralization steps to prevent the contact with strong base resulting in the formation of undesirable ammonium.

Container

Preferred containers are transparent/translucent bottles. "Transparent" as used herein includes both transparent and translucent and means that a composition, or a package according to the invention preferably has a transmittance of more than 25%, more preferably more than 30%, most preferably more than 40%, optimally more than 50% in the visible part of the spectrum (approx. 410-800 nm). Alternatively, absorbency may be measured as less than 0.6 (approximately equivalent to 25% transmitting) or by having transmittance greater than 25% wherein % transmittance equals: $1/10^{absorbancy} \times 100\%$. For purposes of the invention, as long as one wavelength in the visible light range has greater than 25% transmittance, it is considered to be transparent/translucent.

Transparent bottle materials with which this invention may be used include, but are not limited to: polypropylene (PP), polyethylene (PE), polycarbonate (PC), polyamides (PA) and/or polyethylene terephthalate (PETE), polyvinylchloride (PVC); and polystyrene (PS).

The preferred inventive compositions which are packaged into transparent containers include an opacifier to impart a pleasing appearance to the product. The inclusion of the opacifier is particularly beneficial when the liquid detergent compositions in the transparent containers are in colored. The preferred opacifier is styrene/acrylic co-polymer. The opacifier is employed in amount of from 0.0001 to 1%, preferably from 0.0001 to 0.2%, most preferably from 0.0001 to 0.04%.

The container of the present invention may be of any form or size suitable for storing and packaging liquids for household use. For example, the container may have any size but usually the container will have a maximal capacity of 0.05 to 15 L, preferably, 0.1 to 5 L, more preferably from 0.2 to 2.5 L. Preferably, the container is suitable for easy handling. For example the container may have handle or a part with such dimensions to allow easy lifting or carrying the container with one hand. The container preferably has a means suitable for pouring the liquid detergent composition and means for reclosing the container. The pouring means may be of any size of form but, preferably will be wide enough for convenient dosing the liquid detergent composition. The closing means may be of any form or size but usually will be screwed or clicked on the container to close the container. The closing means may be cap which can be detached from the container. Alternatively, the cap can still be attached to the container, whether the container is open or closed. The closing means may also be incorporated in the container.

Method of Using Compositions

In use, the indicated quantity of the composition (generally in the range from 50 to 200 ml) depending on the size of the laundry load, the size and type of the washing machine, is added to the washing machine which also contains water and the soiled laundry. The inventive compositions are particularly suited for use with front-loading washing machine, due to the ability of the inventive compositions to deliver high performance with low foaming—front-loading machines require low foaming compositions.

The following specific examples further illustrate the invention, but the invention is not limited thereto.

The following abbreviations and/or tradenames were used in the Examples:

MEE: 9-EO Methyl ester ethoxylate of coco fatty acid

LAS acid: lineal alkylbenzenesulfonic acid

NA-LAS: sodium linealalkylbenzenesulfonate

Neodol 25-9: 9 EO ethoxylated fatty alcohol

BHT: Butylated hydroxytuluene

TEA: triethanolamine

SLES: sodium alcohol ethoxylate sulfate

SRI Grass Stain Evaluation

Evaluation for removal of soil was conducted from a single wash in warm water at 32.5° C. A benchmark detergent was also tested for the purpose of comparison. The fabric used in the test was cotton. A Hunter reflection meter was used to measure L, a, and b which are taken to calculate SRI Index values using the following equation: $SRI=100-[(L_f-L_i)^2+(a_f-a_i)^2+(b_f-b_i)^2]^{1/2}$. The higher the SRI value, the better the cleaning.

EXAMPLE 1 AND COMPARATIVE EXAMPLE A

Example 1 (within the scope of the present invention) and Comparative Example A (outside the scope of the present invention) demonstrated the effect of the inclusion of urea in alkoxylated ester-containing compositions on the removal of grass stains. Both Examples were prepared by the order of addition following the order of ingredients listed in Table 1. The pH values of wash liquor of both examples were about neutral and are listed in Table 1.

TABLE 1

| | Example | |
|---|---|---|
| | A | 1 |
| water | 70.0 | 70.0 |
| Borax | 0.3 | 0.3 |
| NaOH | 1.4 | 1.4 |
| citric acid | 0.5 | 0.5 |
| LAS acid | 8.6 | 8.6 |
| MEE-9EO | 8.3 | 8.3 |
| Premix | | |
| PW | 0.1 | 0.1 |
| water | 1.7 | 1.7 |
| Urea | | 2.0 |
| Misc | To 100 | To 100 |
| Wash pH | 7.04 | 7.08 |
| SRI of grass stain | 58.4 | 60.2 |

The SRI value of Example 1 was higher than Comparative example A, demonstrating the synergistic effect of MEE formulation with the addition of urea.

EXAMPLE 2 AND COMPARATIVE EXAMPLE B

Both Comparative Example B (which was outside the scope of the present invention) and Example 2 (within the scope of the invention) were prepared by the order of addition following the order of ingredients listed in Table 2. The pH values of wash liquor of both examples were about 7.5 as listed in Table 2.

TABLE 2

| | Example | |
|---|---|---|
| | B | 2 |
| water | 70.0 | 70.0 |
| Borax | 0.3 | 0.3 |
| NaOH | 1.4 | 1.4 |
| TEA | 1.0 | 1.0 |
| citric acid | 0.5 | 0.5 |
| LAS | 8.6 | 8.6 |
| MEE-9EO | 8.3 | 8.3 |
| Premix | | |
| PW | 0.1 | 0.1 |
| water | 1.7 | 1.7 |
| Urea | | 2.0 |
| Misc | To 100 | 0.00 |
| Wash pH | 7.47 | 7.45 |
| SRI | 57.4 | 60.4 |

The SRI value of Example 2 was about 3 units higher than Comparative example B, demonstrating the synergy effect of MEE formulation with the addition of urea is enhanced at less than alkaline pH.

COMPARATIVE EXAMPLES C-H

These comparative examples demonstrate that the urea, in the absence of an alkoxylated ester surfactant, did not have any benefit in removing grass stain under various pH conditions. Typically, 0.036% and 0.09% of urea in the wash liquor are equivalent to 2% and 5% concentration in a detergent formulation, respectively. The results that were obtained are sumarised in Table 3.

TABLE 3

| | Example | | | | | |
|---|---|---|---|---|---|---|
| Ingredient | C parts | D parts | E parts | F parts | G parts | H parts |
| water | 100 | 99.964 | 99.91 | 100 | 99.964 | 99.91 |
| urea | | 0.036 | 0.090 | | 0.036 | 0.090 |
| triethanol-amine | | | | To pH = 7.5 | To pH = 7.5 | To pH = 7.5 |
| Wash pH | 6.96 | 6.94 | 6.95 | 7.5 | 7.5 | 7.5 |
| SRI of grass stain | 61.9 | 61.4 | 61.6 | 70.2 | 70.2 | 70.1 |

The data in Table 3 illustrates that urea, in the absence of an alkoxylated ester surfactant, did not improve the detergency of grass stain removal from the substrate at either pH of 6.95 and 7.5.

What is claimed is:

1. An aqueous liquid laundry detergent composition comprising:

(a) from about 5% to about 80%, by weight of the composition, of a detergent surfactant, wherein from about 1% to about 80%, by weight of the composition is an alkoxylated carboxylic acid ester surfactant of formula (I):

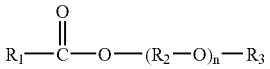

wherein $R_1$ is selected from linear or branched $C_6$ to $C_{22}$ alkyl or alkylene groups;

$R_2$ is selected from $C_2H_4$ or $C_3H_6$ groups;

$R_3$ is selected from H, $CH_3$, $C_2H_5$ or $C_3H_7$ groups; and n has a value between 1 and 20, (b) from about 0.1% to about 3% of urea;

(c) wherein the pH of the composition is in the range from about 6 to about 8;

(d) a free radical scavenger in an amount up to 0.05%, with the mole ratio of the alkoxylated ester to the free radical scavenger of from 200:1 to 50:1;

(e) from about 15% to about 90% of water.

2. The composition of claim 1 wherein the composition comprises an alkaline builder.

3. The composition of claim 1 wherein the pH of the composition is in the range from about 6.5 to 8.0.

4. A method of removing grass stains from laundry, the method comprising washing laundry in an aqueous medium comprising the composition of claim 1.

* * * * *